US005196049A

United States Patent [19]

Coombs et al.

[11] Patent Number: 5,196,049

[45] Date of Patent: Mar. 23, 1993

[54] ATOMIZING APPARATUS AND PROCESS

[75] Inventors: Jeffrey S. Coombs, West Glamorgan; Gordon R. Dunstan, Swansea, both of United Kingdom

[73] Assignee: Osprey Metals Limited, United Kingdom

[21] Appl. No.: 623,459

[22] Filed:

[22] PCT Filed: June 6, 1989

[86] PCT No. PCT/GB89/00627

§ 371 Date: Dec. 5, 1990

§ 102(e) Date: Dec. 5, 1990

[87] PCT Pub. No.: WO89/12116

PCT Pub. Date: Dec. 14, 1989

[30] Foreign Application Priority Data

Jun. 6, 1988 [GB] United Kingdom ..... 8813338

[51] Int. Cl.[5] ..... C23C 4/12; B22F 9/08

[52] U.S. Cl. ..... 75/338; 264/12; 266/202; 425/7

[58] Field of Search ..... 75/337, 338, 339; 425/6, 7; 264/12; 266/174, 202

[56] References Cited

U.S. PATENT DOCUMENTS

| | | | |
|---|---|---|---|
| 3,663,206 | 5/1972 | Lubanska | 75/337 |
| 4,626,278 | 12/1986 | Kenney et al. | 75/338 |
| 4,806,150 | 2/1989 | Alvarez et al. | 425/6 |
| 4,869,469 | 9/1989 | Eylon et al. | 266/202 |

FOREIGN PATENT DOCUMENTS

| | | | |
|---|---|---|---|
| 3732365 | 4/1988 | Fed. Rep. of Germany | 75/337 |
| 56-142805 | 11/1981 | Japan | 75/338 |

*Primary Examiner*—George Wyszomierski

*Attorney, Agent, or Firm*—Brown, Martin, Haller & McClain

[57] ABSTRACT

Apparatus for the production of powders or spray deposits is provided in which a metal or metal alloy stream is broken up into atomized droplets by primary jets of atomizing gas. In order to remove further heat from the atomized droplets, secondary jets are positioned adjacent the primary jets for directing cooling fluid in the form of cryogenic liquified gas at the atomized droplets. The apparatus permits the formation of coarser powders, powders from alloys with a wide solidus/liquidus gap in a shorter atomizing chamber, or spray deposits with increased yield of deposited material.

11 Claims, 5 Drawing Sheets

Figure 1:
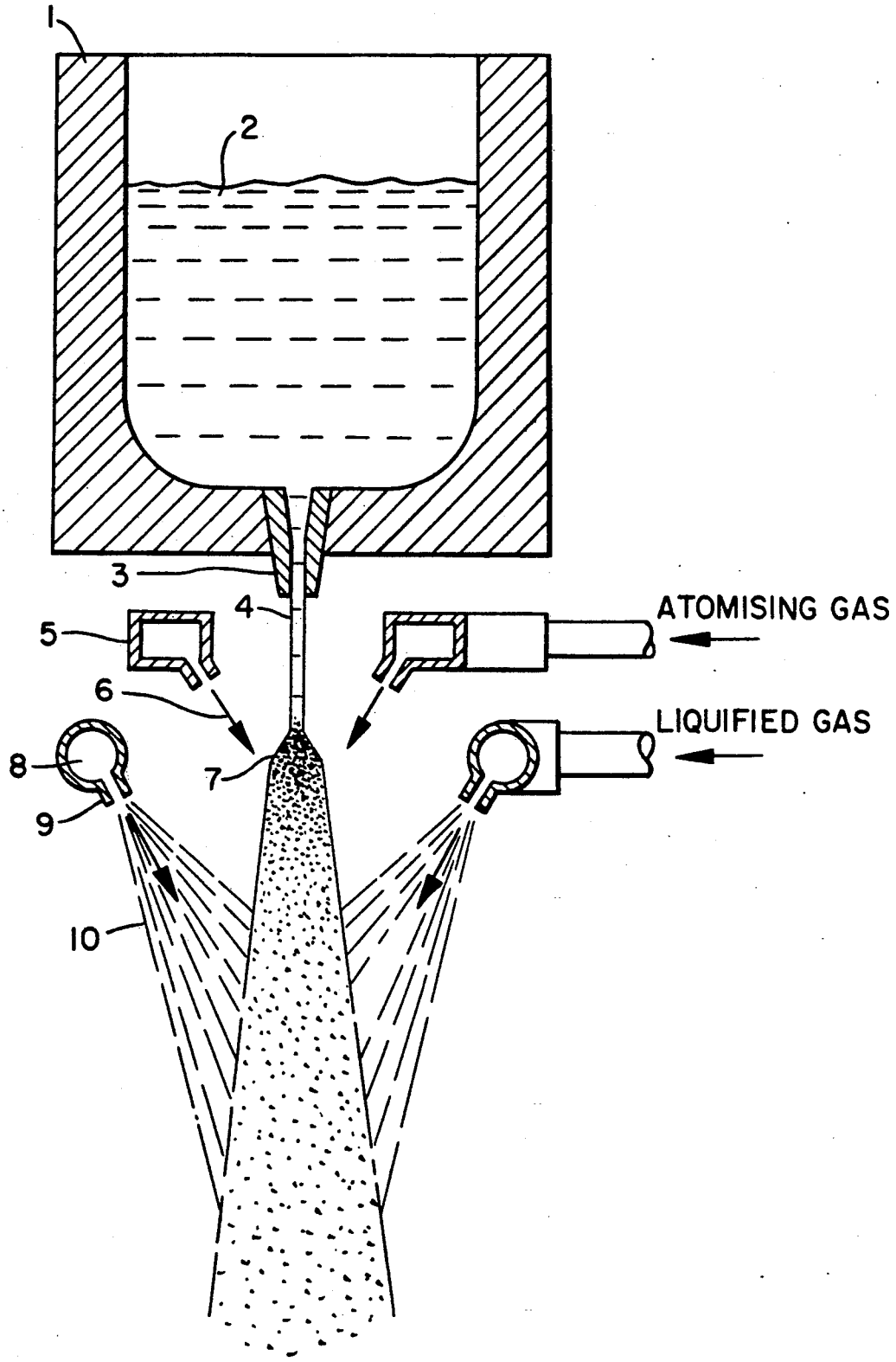

| Run Identity | Charge Weight Kg | Pouring Temp. °C | Metal Flow Rate Kg/min | Atomising Gas Flow Rate $M^3$/min | Atomising Gas Pressure barg | Atomising Gas:Metal Ratio $M^3$/kg | Liquid Nitrogen Pressure barg | Liquid Nitrogen Flow Rate kg/min | Metal Stream Diameter mm | Mean Particle Diameter micron | Standard Deviation | Weight of base deposit | % base deposit of material poured |
|---|---|---|---|---|---|---|---|---|---|---|---|---|---|
| A | 118.0 | 1630 | 22.6 | 25.0 | 6.9 | 1.10 | 0 | 0 | 5.5 | 83.1 | 2.15 | 0 | 0 |
| B | 77.6 | 1630 | 28.0 | 19.5 | 5.2 | 0.69 | 0 | 0 | 6.0 | 93.7 | 2.15 | 4.7 | 6.1 |
| C | 35.0 | 1620 | 30.8 | 24.9 | 6.9 | 0.81 | 1.03 | NA | 8.0 | 93.4 | 2.47 | 0 | 0 |
| D | 74.0 | 1610 | 26.4 | 16.0 | 4.0 | 0.61 | 0.90 | 5.7 | 6.0 | 118.2 | 2.14 | 0 | 0 |
| E | 57.6 | 1620 | 25.9 | 12.1 | 2.8 | 0.47 | 1.03 | 9.2 | 6.0 | 187.4 | 2.30 | 0 | 0 |
| F | 17.0 | 1620 | 22.4 | 9.4 | 1.9 | 0.42 | 1.03 | NA | 6.0 | 295.9 | 2.36 | 0 | 0 |
| G | 52.2 | 1610 | 23.0 | 6.1 | 1.7 | 0.28 | 1.38 | 9.3 | 6.0 | 368.2 | 2.62 | 0.6 | 1.2 |
| H | 67.0 | 1620 | 44.0 | 16.4 | 4.1 | 0.37 | 1.38 | 11.2 | 8.0 | 133.8 | 2.52 | 1.6 | 2.4 |
| I | 64.4 | 1630 | 40.7 | 13.1 | 3.1 | 0.32 | 1.38 | 11.6 | 8.0 | 167.4 | 2.48 | 10.6 | 16.5 |

FIG. 4

| Alloy | Weight of Metal Atomised kg | Metal Flow Rate kg/min | Atomising Gas Pressure Bar Gauge | Atomising Gas ($N_2$) Flow Rate $m^3$/min | Liquid Gas ($N_2$) Flow Rate kg/min | Powder Mean Particle Size (Microns) | Weight of Base Deposit kg | % Base Deposit of Weight atomised |
|---|---|---|---|---|---|---|---|---|
| A | 98.5 | 18.4 | 2.76 | 12.27 | None | 65 | 5.54 | 5.6 |
| A | 103.8 | 19.9 | 2.41 | 11.22 | 4.7 | 68 | 1.02 | 0.98 |
| B | 103.9 | 19.9 | 2.41 | 11.22 | None | 60 | 6.22 | 5.99 |
| B | 105.0 | 20.1 | 2.41 | 11.22 | 4.6 | 58 | 1.02 | 0.97 |
| A | 1750.0 | 18.14 | 2.76 | 7.4 | None | 85 | 150.0 | 8.57 |
| A | 1750.0 | 17.39 | 2.76 | 7.4 | 5 | 94 | 14.8 | 6.85 |
| B | 1260.0 | 17.97 | 2.76 | 7.4 | 5 | 58 | 29.6 | 2.35 |

Alloy A: Bal Cu, 10 wt% Pb, 10 wt% Sn, 0.2 wt% P
Alloy B: Bal Cu, 30 wt% Pb, 0.05 Wt% P

FIG. 5

ATOMIZING APPARATUS AND PROCESS

This invention relates to a method and apparatus for atomising a liquid stream of metal or metal alloy. In one aspect the invention relates to producing powders, particularly coarse powders and powders from metal or metal alloys that have a large solidus-liquidus temperature gap. In another aspect the invention relates to an improved spray deposition process.

A problem with the production of coarse powders where optimisation of yields within coarse size ranges are required, for example as-atomised powders with a mean particle size typically greater than 100 microns, is that the recovery of the powder can be markedly reduced by deposition and/or coalescence and/or adherence of hot coarse particles in a soft and/or semi-liquid state on the surfaces of or within the containment vessel in which atomisation is carried out. For example, in a typical atomising unit for producing powder by atomisation of a liquid metal or metal alloy stream, the metal is atomised in an atomising chamber which is about 4.5 meters in height. In order to produce powders with high yields in coarse size ranges in such an apparatus the liquid metal or alloy stream has to be broken up by means of a low atomising gas to metal ratio. Whilst this provides less break-up of the stream and thus coarser particles, many of the particles will remain too hot for too long, both due to the intrinsically slower cooling of coarse powders and the low ratio of cold gas to metal concomitant with the achievement of the coarse powder, so that some particles will still be liquid or semi-liquid or soft when they reach the base of the atomising chamber and therefore will splat, agglomerate and adhere on the chamber base. As will be understood this reduces the possible recovery of metal powder of a particular size range from the total metal poured. The build up of deposited material causes a further problem in atomisation chambers where a base exit pipe for continuous removal of the product is provided since the build up of deposit can block the powder/gas exit and cause the process to be halted.

A similar problem is encountered when producing powders from metal alloys which have a wide solidus to liquidus gap and which also require, on the one hand a specific low gas to metal ratio in order to provide the desired powder particle size and, on the other hand, as much relatively cold gas as possible in the immediate environment of the powder particles composing the spray in order to remove sufficient heat to ensure that the particles are solid by the time they reach the base of the chamber.

One solution would be to increase the height of the atomising chamber so that the particles would have a longer time to cool in flight before reaching the base of the atomising chamber. However, such a solution is not a practical one in view of the size of apparatus that would be required and increased costs of buildings to house the equipment.

A problem when effecting spray deposition of gas atomised metal or metal alloy is to ensure that depositing droplets are sufficiently solidified and of such a size to provide optimum depositing conditions and yield which tends to be reduced the greater the spray height. Accordingly, an object of this invention is to provide a method of atomising and an atomising apparatus which permits the production of coarse powders or powders with a wide solidus/liquidus gap, or semi-solid/semi-liquid droplets for deposition to be produced in a relatively compact atomising unit.

According to one aspect of the present invention there is provided a method of atomising a liquid stream of metal or metal alloy comprising the steps of:

teeming a stream of molten metal or metal alloy into an atomising device, atomising the stream with atomising gas at a temperature less than that of the metal or metal alloy to form droplets of metal or metal alloy, and removing further heat by directing cooling fluid at the stream or droplets. Preferably the atomising gas issues from first jets and the cooling fluid issues from second jets directed at the atomised droplets. The method may be for the production of coarse powder or powder from alloys with a wide solidus/liquidus gap, said secondary jets being of low velocity so as to have substantially no effect on the particle size distribution which is determined substantially solely by the gas of the primary jets. Alternatively, the method may be for the production of spray deposits. The secondary jets may be arranged to be positioned closely to the atomising gas jets to facilitate efficient mixing and incorporation into the spray of metal or alloy particles and droplets or, alternatively, the cooling fluid and atomising gas may be applied through the same jets. Suitably, the cooling fluid is a liquified inert gas such as Argon or Helium or liquid Nitrogen directed at the atomised droplets at low pressure, for example of the order of 0.5 to 2.5 barg, so that they merely further cool the droplets but do not affect their size. The atomising gas is suitably Air, Argon, Helium, or Nitrogen. The use of cryogenic liquified gas such as Argon or Nitrogen permits production of low oxygen content particles. The selection of Nitrogen or Argon for example, is made on the basis of the reactivity of the liquid metal or alloy constituents and the propensity for nitride formation and its desirability.

According to another aspect of the invention there is provided atomising apparatus comprising an atomising device for receiving a stream of molten metal or metal alloy to be atomised, means for directing atomising gas, at a temperature less than that of the metal or metal alloy, at the liquid stream to break the stream into atomised droplets, and means for directing cooling fluid at the stream or atomised droplets for removing further heat therefrom. In the preferred arrangement the means for directing the atomising gas comprises primary jets and the means for directing the cooling fluid comprises secondary jets directed at the atomised droplets. However, alternatively, the atomising gas and cooling fluid may be introduced simultaneously through common jets. Preferably the cooling fluid is applied through the secondary jets so as to extract heat without substantially affecting the size distribution which is determined by the atomising gas.

Suitably, the secondary jets are arranged to direct a cryogenic liquified gas at the atomised droplets, the liquified gas being applied at low pressure, typically, of the order of 0.5 to 2.5 barg. In order to determine the amount of liquified gas to be applied the apparatus preferably also includes means for monitoring the temperature within the spray chamber relative to a set datum temperature so that a signal may be generated indicative of the sensed temperature. The signal is suitably fed to control means for controlling the supply of liquified gas according to the sensed temperature reductions. The sensing means may be, for example, a plurality of thermocouples positioned in the base of the spray chamber. With the apparatus of the present invention it is possible to achieve high yields of powder in size ranges which require mean particle sizes of up to 250 micron for optimisation (e.g. −500+100 microns where optimum mean particle diameter is 224 microns, or, −300+150 microns where the optimum mean particle diameter is 212 microns, or, −180+75 microns where the optimum mean particle diameter is 116 microns). The supplied liquid gas is preferably liquid Nitrogen.

Alternatively, the apparatus may be used to produce spray deposits on a suitable collector.

Figure 2A:
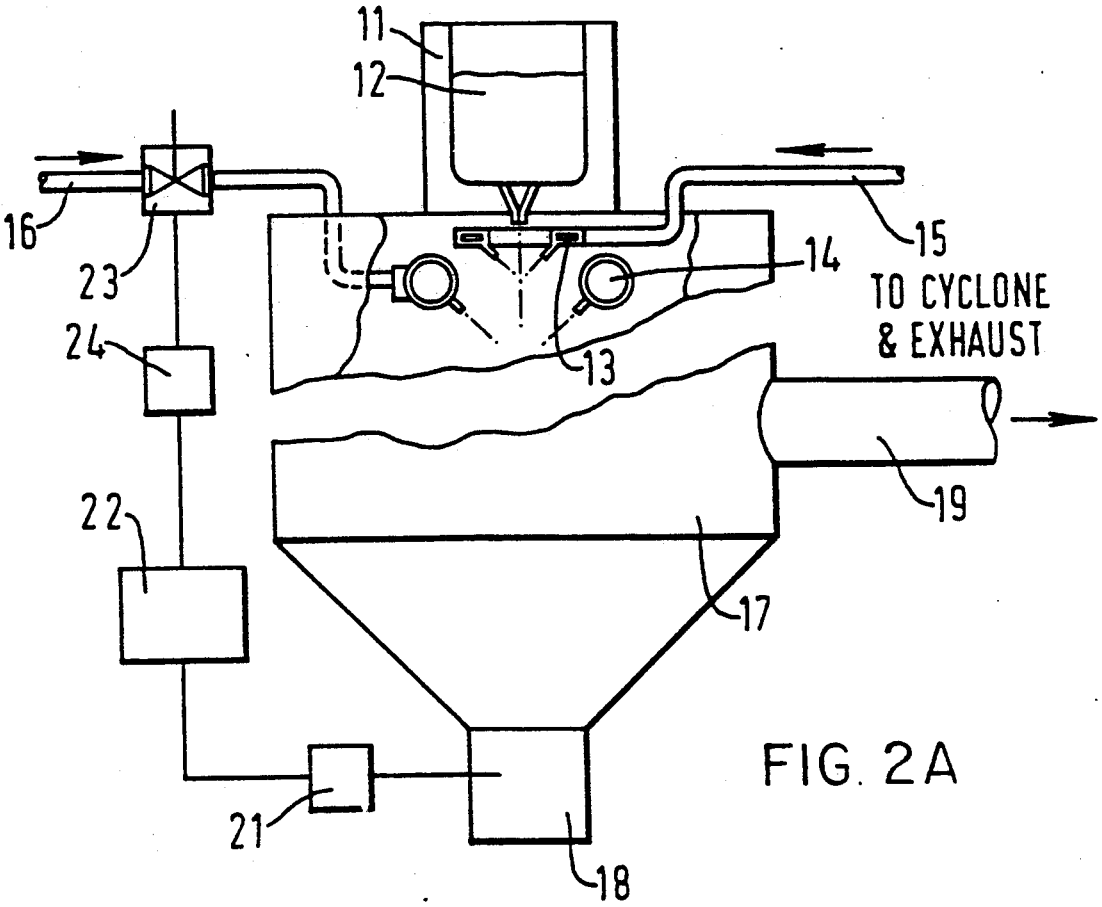
Figure 2B:
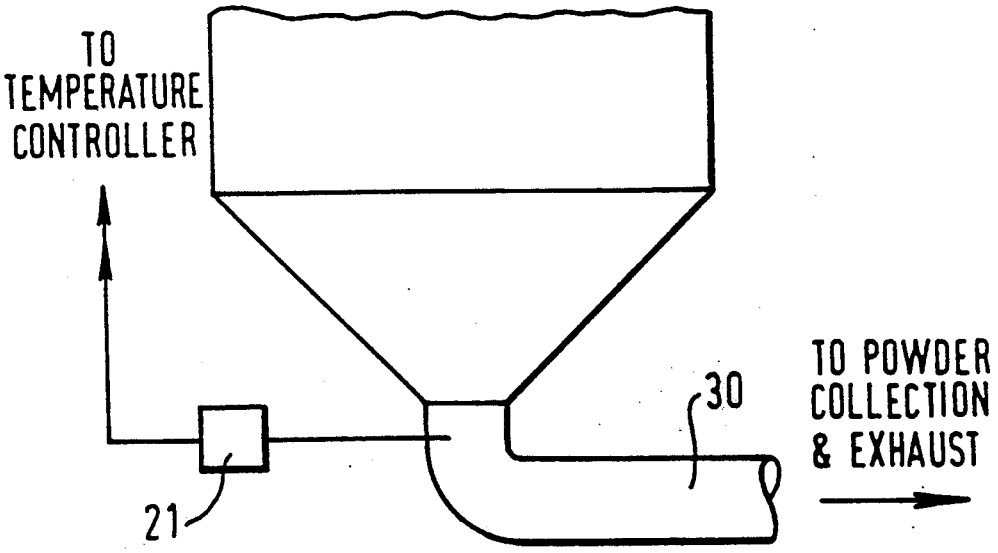
Figures 3A, 3B:
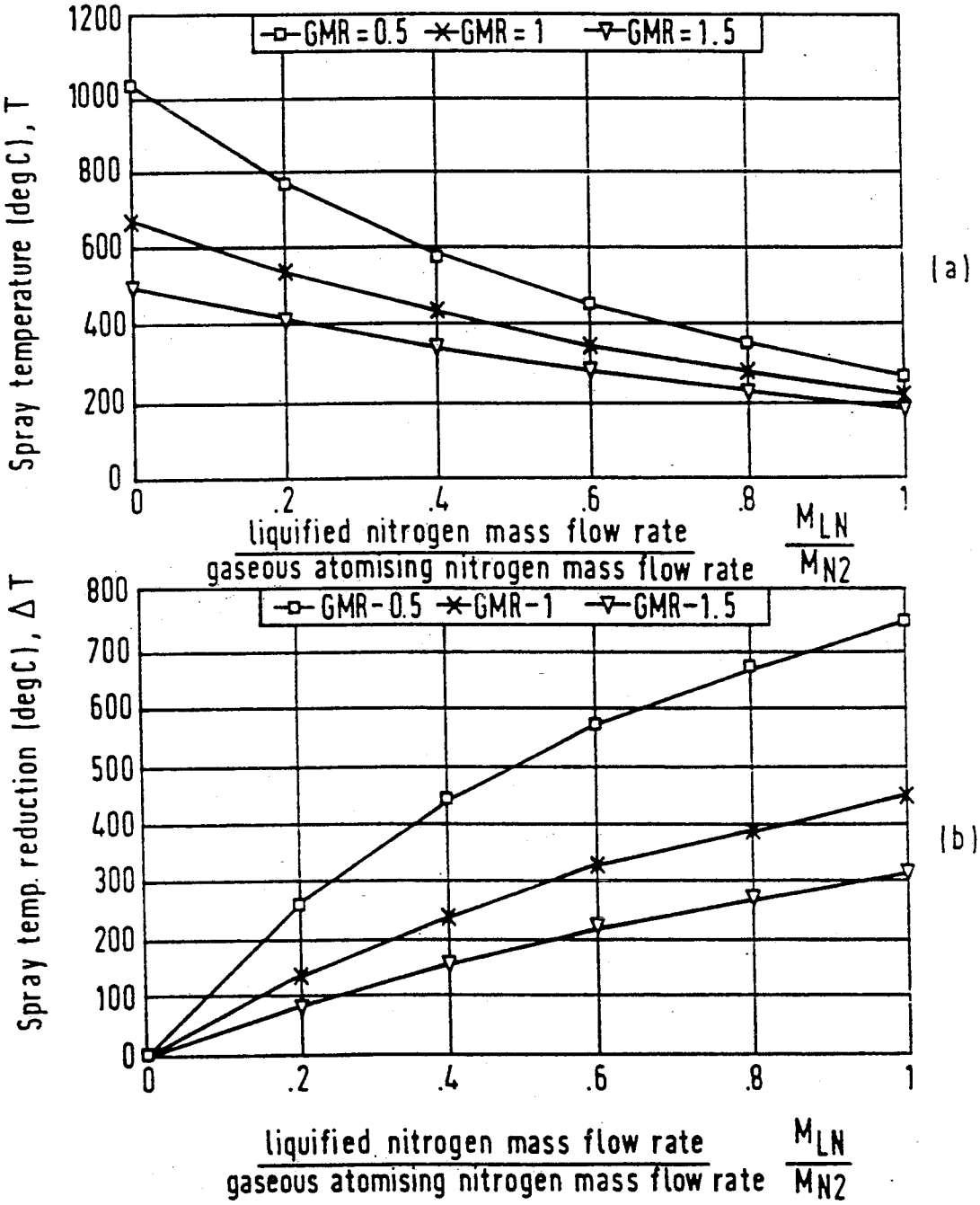

The invention will now be described by way of example with reference to the accompanying in which:

FIG. 1 is a diagrammatic sectional side elevation of a gas atomising apparatus in accordance with the invention;

FIGS. 2(*a*) and 2(*b*) show a diagrammatic side elevation of apparatus for producing powders including the atomising apparatus according to the invention together with an alternative base arrangement;

FIGS. 3(*a*) and 3(*b*) show the effect on the temperature of the spray and the cooling effect of applied liquid Nitrogen of the ratio of liquid Nitrogen, flow rate to gaseous atomising Nitrogen flow rate for different gas to metal ratios;

FIG. 4 illustrates the effect of applied liquid Nitrogen on 304 type stainless steel under various conditions, and FIG. 5 illustrates the effect of applied liquid Nitrogen on two different alloys A and B having a wide solidus-liquidus freezing range.

In FIG. 1 an atomising apparatus for gas atomising liquid metal or alloy is shown comprising a refractory or refractory lined crucible or tundish (1) for containing liquid metal or alloy (2). The tundish (1) has a ceramic nozzle bottom metering device (3) to provide a liquid metal or alloy stream (4) of a desired diameter. The liquid metal or alloy stream (4) teems into a central opening in a primary gas atomising device (5) which causes a plurality of high velocity gas jets (6) to be directed at the liquid metal or alloy stream (4) so as to break the stream up into a spray of atomised droplets (7). The primary atomising gas jets (6) are composed preferably of Nitrogen, Argon or Helium to provide unoxidised droplets of metal or alloy but Air may also be used where oxidation is permissable or desirable. The atomising assembly also includes a secondary spray station (8), disposed downstream of the primary atomising gas jets (6), containing a plurality of secondary jets (9) which apply liquid Nitrogen or liquid Argon sprays (10) to the liquid or semi-liquid/semi-solid atomised droplets.

In the production of powder, the liquified gas applied at the secondary spray station (8) is kept at relatively low pressure, for example 0.5 to 2.5 barg, so that its low temperature removes heat from the gas/metal spray but its velocity does not make the particles finer. Therefore, the liquified gas spray does not alter the particle size distribution of the powder produced which is determined substantially, or solely by the primary gas atomising jets (6). It has been found that the secondary liquified gas jets work satisfactorily at a distance of 100 mm from the primary gas atomising jets (5) and a secondary liquid gas spray unit consisting of six jets of 4 mm diameter at an angle of thirty degrees to the axis of the metal stream (4) with a pitch circle diameter of 125 mm works well. FIG. 2 shows the apparatus of FIG. 1 as applied to powder forming apparatus. In this figure the crucible/tundish metal dispensing system (11) with liquid metal (12), the gas atomising device (13) and secondary liquified gas spray device (14) are positioned on a spray chamber (17). Atomising gas is supplied to the atomising device (13) via an inlet pipe (15) and liquified gas is supplied to the secondary liquified gas spray device via an inlet pipe (16). At the base of the spray chamber is a powder collection vessel (18), the chamber additionally containing a gas exhaust pipe (19).

At the base of the spray chamber a temperature sensing device (21), which may be in the form of a thermocouple or a plurality of thermocouples, for example, measures the temperature of the powder gas supply and transmits a signal to a temperature controller (22). The temperature controller (22) includes a comparator which compares the measured temperature with a preset datum temperature and according to the difference either increases or decreases the liquified gas flow rate to the secondary liquified gas spray jets (14) by activating the liquified gas control valve (23) via a current to pneumatic pressure (P/I) converter (24). In this way, the application of liquified gas to the spray can be controlled to give a desired temperature to the spray at the chamber base which is selected to be sufficiently low to prevent semi-liquid/semi-solid, or liquid, or very hot and soft particles being present at the chamber base and causing deposition, agglomeration and adhesion to the base of the chamber.

As illustrated in the lower part of FIG. 2, an alternative base design may be used. For example, the chamber base design can accommodate continuous removal of powder using the spent atomising gas as a conveying medium via an exit pipe (30) to a powder collection device (e.g. a cyclone, not shown) external to the chamber. This invention is particularly applicable to the production of coarse powders.

Use of cryogenic liquified gas provides a large heat sink to the atomised metal spray as the cold liquified gas is heated and vaporised to reach the equilibrium temperature with the cooling atomising gas and metal alloy particles.

The extent of this heat sink provided by the cryogenic liquified gas can be seen to be significant by reference to Nitrogen, the specific heat for which is approximately 1.04 KJ/Kg/deg C over the range 100 deg K to 300 deg K with a latent heat of evaporation of approximately 220 KJ/Kg which is comparable with the latent heat of solidification of steel (273 KJ/Kg). The heat balance, assuming heat transfer to equilibrium and no cooling to the atomising chamber walls, can be described by the following equation:

$$\dot{M}_m[Cp_m(Tp-T)+Hs]=\dot{M}_{n2}Cp_{n2}(T-Ta)+\dot{M}_{ln}Cp_{ln}(T+196)+\dot{M}_{ln}He$$

where $\dot{M}_m$ = mass liquid metal flow rate
Cpm = specific heat of liquid metal
Hs = latent heat of solidification
$\dot{M}_{n2}$ = mass atomising Nitrogen gas flow rate
$Cp_{n2}$ = specific heat of Nitrogen
$\dot{M}_{ln}$ = mass liquid Nitrogen flow rate
He = latent heat of evaporation of Nitrogen
Tp = pouring temperature of metal, deg C.
Ta = ambient temperature, deg C.
T = temperature of spray comprising metal and gas mixture.

The extent of the cooling effect of the liquid Nitrogen is given by $\Delta T$ where $\Delta T = T2 - T$ where T2 is the temperature of the spray mixture without liquid nitrogen being added (i.e. $\dot{M}_{ln} = 0$ in the above equation).

FIGS. 3(*a*) and 3(*b*) show the effect on T and $\Delta T$ of the ratio of liquid Nitrogen flow rate to gaseous atomising Nitrogen flow rate for different atomising gas:metal ratios (GMR). The effect of liquid Nitrogen on cooling the spray ($\Delta T$) is increased at low atomising gas:metal ratios (see FIG. 1(*b*)). It is worth noting that at atomising gas:metal ratios of say 0.5, which would provide a coarse powder, the spray temperature reduction, $\Delta T$, is of the order of 500–600 degs C.

The effect of liquid Nitrogen secondary jets on the amount of deposit formed on the chamber base during atomisation of 304 type stainless steel (18 wt % Cr; 9 wt % Ni; 0.15 max wt % C.; balance Fe) atomised under various conditions to a range of mean particle diameters is shown in FIG. 4. The atomiser chamber height was 4.5 m and Nitrogen was used for the atomisation gas.

It is evident that the mean particle diameter of the powders produced increased with decrease in atomisation gas flow rate:metal flow rate ratio. Without application of liquid Nitrogen through secondary jets into the atomising spray no base deposit was obtained at an atomising gas:metal ratio of 1.1 and mean particle diameter of 83.1 microns (see Run A). However, at an atomising gas:metal ratio of 0.69 and mean particle diameter of 93.7 microns a base deposit of 6.1% of the material atomised was obtained (Run B) which caused significant loss of yield and practical difficulties in transporting powder from the chamber and cleaning the chamber base. Run C, at an atomising gas:metal ratio of 0.81 and a mean particle diameter of 93.4 microns (similar to Run B) but with application of liquid Nitrogen cooling did not produce a base deposit. No base deposit was produced in Runs D, E, and F which exhibit decreasing atomisation gas:metal ratios and increasing mean particle diameters of the powders produced of 118, 187, and 296 microns. Run G, producing a mean particle diameter of 368 microns, did exhibit a base deposit even with a liquid Nitrogen flow rate of 9.3 Kg per minute: however, the deposit was only 1.2%. Runs H and I were carried out at very fast metal flow rates of greater than 40 Kg per minute and despite the application of a liquid Nitrogen spray larger base deposits were obtained of up to 16.5% in Run I. Clearly, the use of the secondary liquid Nitrogen jets facilitates the production, without base deposits and concomitant losses in yields, difficulties in powder extraction from the chamber and chamber cleaning, of powders with mean particle diameter of up to 296 microns whereas without liquid Nitrogen, powders with a maximum only of between 83 and 93 microns could be produced. Conversely, use of a secondary liquified gas spray jet system permits the atomising chamber height to be minimised for production of a metal or metal alloy powder of any required specific particle size distribution without problems of deposition of product on the base of the chamber.

Although the invention has particular advantage in producing coarse powders, it may also be used in other applications, for example, with alloys with a wide solidus-liquidus freezing range. For example, by using the method and apparatus of the present invention, alloys of Cu, 30 wt % Pb, 0.05 wt % P (Alloy B) and Cu, 10 wt % Pb, 10 wt% Sn, 0.2 wt % P (Alloy A), which have pour temperatures of between about 1180 degrees Centigrade and 1250 degrees Centigrade and an effective solidus of 327 degrees Centigrade (the melting point of the immiscible lead) can be atomised to produce powder in compact atomising chambers of 4.5 m in height without significant losses in yield due to agglomeration and adherence of powder particles to the base of the atomising chamber.

FIG. 5 shows the effect of using secondary liquified gas jets on decreasing the extent of base deposits obtained during atomisation runs on both alloys. The percentage of metal alloy atomised which was retained as a solid agglomerated deposit on the base of the atomiser chamber was reduced by one sixth to one tenth of that obtained without the use of secondary liquified gas.

A further application of the use of liquified gas injection is in the production of spray deposits. In the production of spray deposits, liquid metal or metal alloy is sprayed onto an appropriate collector. The process is essentially a rapid solidification technique for the direct conversion of liquid metal into a deposit by means of an integrated gas-atomising/spray depositing operation. A controlled stream of molten metal is teemed into a gas atomising device where it is impacted by high velocity jets of gas, usually Nitrogen or Argon. The resulting spray of metal droplets is directed onto the collector where the atomised droplets, which consist of a mixture of fully liquid, semi-solid/semi-liquid and solid particles, are deposited to form a highly dense deposit. The collector may be fixed to a control mechanism which is programmed for the collector to perform a sequence of movements under the spray, so that the desired deposit shape can be generated. In many situations, the spray itself is also moved and many deposit shapes can be generated including tubular shapes, billets, flat products and coated articles. Such products can either be used directly or can be further processed normally by hot or cold working with or without the collector. The above methods are described in more detail in our prior patents including U.K. Patents Nos. 1379261; 1472939, and 1599392, and European Patent Publications 200349; 198613; 225080; 244454, and 225732.

In the above methods atomising conditions are selected (e.g. the distance from the atomiser to the collector surface, the gas to metal ratio, etc.) to ensure on deposition that a coherent deposit can be formed which is sufficiently solidified that it is self supporting (i.e. the collector does not require side walls to prevent liquid metal movement as in a casting process). To achieve these conditions a high gas to metal ratio must be used to ensure a finely atomised spray with its associated high surface area for promoting rapid cooling.

Alternatively, a long spray distance is required to increase the time available for cooling. Each of these two conditions have been found to have disadvantages. For example, if a high gas to metal ratio is used, the proportion of very fine particles (e.g. less than 20 microns) in the spray will increase. Such fine particles solidify extremely rapidly and arrive on the surface of the collector or the already deposited metal in the fully solidified condition, typically at the same temperature as the atomising gas. The high velocity atomising gas is deflected when it impacts the deposition surface and lateral movement of the gas often carries a proportion of the very fine particles (which have a low momentum) away from the deposition surface and they are not deposited; i.e. the fine particles are carried in the direction of the gas. In addition, some of the solid particles can bounce on the surface of the deposit and also subsequently be carried away by the atomising gas. Consequently, the yield of metal deposited is reduced which in turn adversely affects the economics of the process. The coarser particles (e.g. >20 microns) in the spray are generally semi-solid/semi-liquid or fully molten on deposition because of their lower cooling rate. Therefore, because of their higher momentum and increased liquid content are less likely to be carried away by the atomising gas and are more likely to stick to the deposit surface. Consequently, in terms of deposited yield, fine particles in the spray are undesirable.

The use of a large spray distance (often necessary to generate sufficient in-flight cooling) can also be undesirable as the atomised spray is generally of a diverging cone shape and therefore at longer spray distances a larger proportion of the spray can miss the collector thereby reducing the yield of spray deposited metal. Finally, for a given spray height and gas to metal ratio there is a limit on the maximum metal flow that can be tolerated through the atomiser before the spray deposit becomes too high in liquid content and is no longer self supporting. Consequently, there is a limitation on the rate of production of spray deposits.

By means of the present invention the above three limitations can be markedly reduced in their effect. For example, the use of an injected liquified phase increases cooling during flight of the initially atomised droplets and therefore a higher metal flow rate can be tolerated. As a second option, the spray height can be reduced as a result of an increased rate of cooling, therefore increasing the yield. A third option is to reduce the gas to metal ratio during the atomising stage thereby producing a coarser spray but compensating for the normally lower cooling rate of a coarser spray by injecting a liquid phase into the spray. All these effects can be generated either individually or in combination with each other.

The invention has been shown to have particular advantages with alloys of high latent heat and/or with alloys of relatively low melting point. For example, the invention is particularly advantageous when practiced with aluminium alloys which have a low melting pint (e.g. approx. 660 degrees Centigrade) relative to the atomising gas temperature (normally ambient temperature) and a high latent heat (e.g. Al-20% Si alloys).

Nevertheless, the invention can be applied to all metals and metal alloys that can be melted including magnesium alloys, copper alloys, nickel and cobalt base alloys, titanium alloys, iron alloys, etc. The invention is normally practiced in the same manner as that described for coarse powder production in that the gas atomising stages and liquid injection stages are separate and the injected liquified gas does not markedly influence the size of the atomised droplets but only their subsequent cooling rate. In addition, the injected liquified gas is normally the same chemical composition as the atomising gas preferably Nitrogen or Argon. However, an alternative method of operating the invention is to inject the liquified gas together with the gas of the same composition through the same atomising jets. This has the advantage of providing a more intimate mixture with the subsequently atomised metal droplets. The liquid phase also changes to its gaseous state during atomisation and deposition therefore extracting a considerable amount of heat during the state change. Furthermore, the gas flowing over the surface of the deposit surface also assists in cooling.

EXAMPLE OF THE USE OF LIQUID NITROGEN IN THE PRODUCTION OF SPRAYDEPOSITED BILLET PREFORMS

The example below illustrates the conditions used for the production of two identically shaped preforms (150 mm diameter ×100 mm height) in a T15 high speed steel alloy. In both cases atomised high speed steel was deposited onto a rotating disc-shaped collector. In Example A only atomising gas was used in the conventional manner of production and the metal flow rate required to give a preform of high density (typically greater than 99.5% of theoretical density with a grain size in the rate 10–25 microns) was 28 Kg per minute. In Example B liquid Nitrogen was introduced into the spray below the main atomising gas jets. Otherwise, the atomising was carried out under identical conditions to Example A. However, in this case, by the introduction of 5 Kg per minute of liquid Nitrogen the metal flow rate can be increased to 43 Kg per minute to produce a spray-deposited preform of similar quality to that of Example A.

| | EXAMPLE A | EXAMPLE B |
|---|---|---|
| Alloy | T.15 | T.15 |
| Metal Dispensing Temperature (deg. C.) | 1530 | 1530 |
| Metal Flow Rate (Kg per min.) | 28 | 43 |
| Atomising Gas (N2) Flow Rate (m3 per min.) | 21.8 | 21.8 |
| Liquid Nitrogen Flow Rate (Kg per min.) | 0 | 5 |
| Atomising Gas to Metal Ratio (Nm3 per Kg) | 0.78 | 0.51 |
| Overall Gas to Metal Ratio (Nm3 per Kg) | 0.78 | 0.65 |
| Spray Height (mm) | 520 | 520 |
| Collector Diameter (mm) | 150 | 150 |
| Collector Rotation Speed (Hz) | 3.2 | 3.2 |

Our prior patent for spray deposition (Patent Publication No. 198613) also claims methods for producing rapidly solidified deposits or metal matrix composites where particles of the same or different composition (either metallic or non-metallic) of the metal to be atomised are introduced into the atomised spray and subsequently spray deposited. By means of the present invention there is provided a method for using the injected liquid phase (e.g. liquid Nitrogen) to conduct the particles into the atomised spray. Such a method of incorporating the particles into a liquid offers a very simple method of carrying particles into the spray, particularly fine particles (e.g. <40 microns) which can be difficult to transport by conventional means.

We claim:

1. A method of atomizing a liquid stream of metal or metal alloy for the production of powders or spray deposits comprising the steps of:

providing an atomizing device;

teeming a stream of molten metal or metal alloy into said atomizing device;

providing primary jets at said atomizing device for applying atomizing gas at the stream to atomize the stream;

providing secondary jets for the application of cryogenic liquified gas;

atomizing the stream with atomizing gas issuing from the primary jets, said gas being at a temperature less than the temperature of the metal or metal alloy, and said gas atomizing the stream into a plurality of atomized droplets of metal or metal alloy having a mean axis and a certain size distribution; and removing further heat from the atomized droplets by directing cryogenic liquified gas from secondary jets substantially at the mean axis of the spray of atomized droplets at a pressure such that the secondary jets have substantially no effect on said size distribution which is determined substantially solely by the gas of the primary jets.

2. A method according to claim 1, comprising positioning the secondary jets closely to the atomizing gas primary jets to facilitate efficient mixing and incorporation into the spray of metal or metal alloy droplets.

3. A method according to claim 1 or 2, wherein the secondary jets direct cryogenic liquified gas at the atomized droplets at a low pressure between 0.5 and 2.50 barg.

4. A method according to claim 1, wherein the cryogenic liquified gas changes to a gaseous phase during cooling of the droplets.

5. A method according to claim 1, for producing powder comprising the further steps of sensing the temperature of the spray, comparing the sensed temperature with a set datum temperature and varying the flow of cryogenic liquified gas according to the compared relationship.

6. Atomizing apparatus for the production of powders or spray deposits, the apparatus comprising a spray chamber, an atomizing device for receiving a stream of molten metal or metal alloy to be atomized, primary jets at said atomizing device for directing atomizing gas, at a temperature less than that of the metal or metal alloy, at the liquid stream to break the stream into atomized droplets of a certain size distribution within the spray chamber, secondary jets for directing cryogenic liquified gas at the atomized droplets for removing further heat therefrom, control means for controlling the pressure of the cryogenic liquified gas whereby, in application, the liquified gas has substantially no effect on the size distribution which is determined substantially solely by the gas of the primary jets, and a collector disposed in the path of the atomized droplets and on which a coherent deposit may be formed, the collector being movable relative to the spray.

7. Apparatus according to claim 6, wherein the liquified gas is applied at a low pressure of between 0.5 and 2.5 barg.

8. Apparatus according to claim 6 or 7, further including sensing means for monitoring the temperature within the spray chamber, comparator means for comparing the monitored temperature relative to a set datum temperature and for generating a control signal dependent on the compared relationship, and control means responsive to said control signal for controlling the supply of liquid gas to the secondary jets according to the compared relationship.

9. Apparatus according to claim 6, for producing powder, the apparatus further including powder collection means.

10. Apparatus according to claim 6, wherein the spray of atomized droplets has a mean axis, and the atomizing device is movable, such that movement of the atomizing device during gas atomization causes movement of the mean axis of the spray.

11. Apparatus according to claim 6 including means for introducing solid particles into the cryogenic liquified gas which acts as a transport vehicle for the particles to be codeposited with the atomized droplets. c

* * * * *